US011536059B2

(12) United States Patent
Rosales

(10) Patent No.: US 11,536,059 B2
(45) **Date of Patent: *Dec. 27, 2022**

(54) MOTOR VEHICLE LOCK

(71) Applicant: Brose Schliesssysteme GmbH & Co. Kommanditgesellschaft, Wuppertal, Wuppertal (DE)

(72) Inventor: David Rosales, Rochester Hills, MI (US)

(73) Assignee: Brose Schliesssysteme GmbH & Co. Kommanditgesellschaft, Wuppertal, Wuppertal (DE)

( * ) Notice: Subject to any disclaimer, the term of this patent is extended or adjusted under 35 U.S.C. 154(b) by 577 days.

This patent is subject to a terminal disclaimer.

(21) Appl. No.: 16/414,190

(22) Filed: May 16, 2019

(65) Prior Publication Data

US 2020/0362599 A1 Nov. 19, 2020

(51) Int. Cl.

| | |
|---|---|
| ***E05B 81/20*** | (2014.01) |
| ***E05B 85/04*** | (2014.01) |
| ***E05B 81/30*** | (2014.01) |
| ***E05B 81/04*** | (2014.01) |

(52) U.S. Cl.

CPC ..... *E05B 81/20* (2013.01); *E05B 81/04* (2013.01); *E05B 81/30* (2013.01); *E05B 85/045* (2013.01)

(58) Field of Classification Search

CPC ..... E05B 81/20; E05B 81/48; E05B 81/04; E05B 81/30; E05B 85/045; Y10S 292/04

See application file for complete search history.

(56) References Cited

U.S. PATENT DOCUMENTS

| | | | | |
|---|---|---|---|---|
| 6,471,259 | B1 | 10/2002 | Weyerstall et al. | |
| 6,557,910 | B2 * | 5/2003 | Amano | E05B 81/14 292/201 |
| 7,261,338 | B2 * | 8/2007 | Spurr | E05B 81/20 292/201 |
| 8,757,681 | B2 * | 6/2014 | Graute | E05B 81/14 292/201 |
| 2018/0171677 | A1 * | 6/2018 | Im | E05B 81/06 |
| 2019/0145135 | A1 * | 5/2019 | Lebsak | E05B 81/20 292/229 |
| 2020/0115932 | A1 * | 4/2020 | Ottino | E05B 85/26 |
| 2021/0010304 | A1 * | 1/2021 | Rosales | E05B 81/66 |

FOREIGN PATENT DOCUMENTS

| | | | | |
|---|---|---|---|---|
| DE | 19700887 | A1 * | 7/1998 | E05B 81/44 |

* cited by examiner

*Primary Examiner* — Kristina R Fulton
*Assistant Examiner* — James E. Ignaczewski
(74) *Attorney, Agent, or Firm* — Brooks Kushman P.C.

(57) ABSTRACT

A motor vehicle lock, including a detent mechanism with a catch and a pawl. The motor vehicle lock may include a drivetrain arrangement with a drive element that may move in a predefined drive direction. During a cinching sequence, the drive element moves in the predefined drive direction, so that the drivetrain arrangement engages and drives the catch in a closing direction to a primary closed position. During a release sequence, the drive element may move in the predefined drive direction, so that the drivetrain arrangement engages and drives the pawl in a release direction to a release state. During the release sequence, the drive element moves in the predefined drive direction, so that the drivetrain arrangement moves to a clearance state, such that the pawl is in a release state and the catch may pivot to an open position drivetrain.

20 Claims, 4 Drawing Sheets

MOTOR VEHICLE LOCK

TECHNICAL FIELD

The present disclosure relates to a motor vehicle lock and a motorized drive.

BACKGROUND

Vehicles may include one or more closures, such as, hatches, doors, tailgates, or liftgates. Certain closures may close and open automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure, by a latch for example, must be sufficient to overcome pressure associated with the closure and the seal. Also, the vehicle may be equipped with a device or mechanism that may automatically release the latch, so the closure may move to an open position.

SUMMARY

According to one embodiment, a motor vehicle lock provided with two motorized functions in order to increase the user-friendliness of the motor vehicle altogether, is provided. One function is the motorized opening of the motor vehicle lock, such that the manual force needed to open the motor vehicle lock is low, independent from environmental conditions such as temperature, humidity, age of the motor vehicle or the like. The other function is the so-called "cinching-function", which provides a motorized closing movement of the assigned closing element just before reaching the fully closed position. This increases the user-friendliness, as this last section of the closing movement is to be performed against those forces, which are being generated by compression of the seals in this last section of the closing movement.

The present disclosure may provide a motor vehicle lock having a simple overall structure and configured to perform a cinching function and an opening function.

The motor vehicle lock may include a detent mechanism with a catch and a pawl. The motor vehicle lock may include a drivetrain arrangement with a drive element, that may be driven in order to perform the opening function and the cinching function. The cinching sequence may realize the cinching function. The release sequence may realize the opening function. In the cinching sequence, the catch is being driven into its primary closed position, while in the release sequence, the pawl is being driven into its release state.

Both above noted functions are realized by driving the single drive element in one and the same, predefined drive direction.

One aspect of the present disclosure is to use the driving element, such as a drive movement of the drive element in the predefined drive direction, to bring the drivetrain arrangement into a clearance state, when the pawl is to be released.

In detail, it is proposed that in the release sequence, by driving the drive element in the predefined drive direction, the drivetrain arrangement enters a clearance state, such that with the pawl in its release state, the catch may pivot into its open position free from the drivetrain arrangement.

With one or more of the proposed solutions, the opening function as well as the cinching function may be realized with one and the same drive element, which is only to be driven in one and the same, predefined drive direction. This means, that the drive element may well be driven via a drive cable such as a bowden cable. This also means that the drive motor, that provides the motorized movement of the drive element, does only need to provide the drive motion in one single direction. This leads to a cost effective and an especially compact mechanical arrangement. Also in view of electrical control, the proposed solution is particularly simple, as the motorized movements have to be generated only in one single direction by the respective motorized drive.

Synchronization between the pawl entering its release state and the drivetrain arrangement entering its clearance state may be provided. In this respect, the proposed solution offers a high constructional flexibility.

The pawl may be released from the holding force of the catch, while or before the pawl is raised into its released position. This may provide low driving forces needed to raise the pawl.

The cinching sequence may include the drive element being reversed to going back on a cinching drive movement of the drive element and the release sequence going back on a release drive movement of the drive element. Those drive movements are preferably separate from each other in view of the respective position of the drive element, which allows a particularly simple constructional arrangement.

The drive element may be coupled to the catch on the one hand and to the pawl on the other hand via two drivetrains, which are at least partly different from each other. Again, this allows to realize the motor vehicle lock with a simple construction.

A catch drivetrain, namely the drivetrain between the drive element and the catch, may include a catch engagement lever. The catch engagement lever may allow a simple realization of the clearance state of the drivetrain arrangement by the engagement lever being deflectable into a deflected state, which represents the clearance state of the drivetrain arrangement.

Deflection of the catch engagement lever may be caused by or at least initiated by an interaction between the catch engagement lever and the engagement surface of the catch. This may be advantageous, as no additional components are necessary to deflect the catch engagement lever.

If the deflection of the catch engagement lever is at least continued by an additional lever the additional lever, such as a deflection lever, may provide a more stable release sequence.

If the deflection lever is connected to a pawl engagement lever, the overall arrangement may be extremely compact.

According to another embodiment, a motor vehicle lock arrangement provided with a motor vehicle lock as noted above and with a motorized drive. The motorized drive may be coupled to the drive element of the drivetrain arrangement of the motor vehicle lock in order to provide a motorized cinching sequence and a motorized release sequence as noted above. All explanations given with respect to the embodiments previously described are fully applicable to this embodiment.

The motorized drive may be arranged separately from the motor vehicle lock. This may allow a modular arrangement of the motor vehicle lock arrangement. However, in one or more embodiments, the motorized drive may be integrated to the motor vehicle lock, to provide a very compact arrangement.

BRIEF DESCRIPTION OF THE DRAWINGS

In the following, one or more embodiments of the present disclosure is explained with respect to the drawings. In the drawings show FIG. 1 a motor vehicle with a proposed motor vehicle lock, FIG. 2 the motor vehicle lock according to FIG. 1 during the cinching sequence with the catch a) in the secondary closed position and b) in the primary closed position, FIG. 3 the motor vehicle lock according to FIG. 1 during the first part of the release sequence with the catch a) in its primary closed position and b) in its overtravel position, FIG. 4 the motor vehicle lock according to FIG. 1 during the second part of release sequence a) with the pawl in its release state and b) with all components of the motor vehicle lock having returned to their respective initial positions.

DETAILED DESCRIPTION

Figure 1:
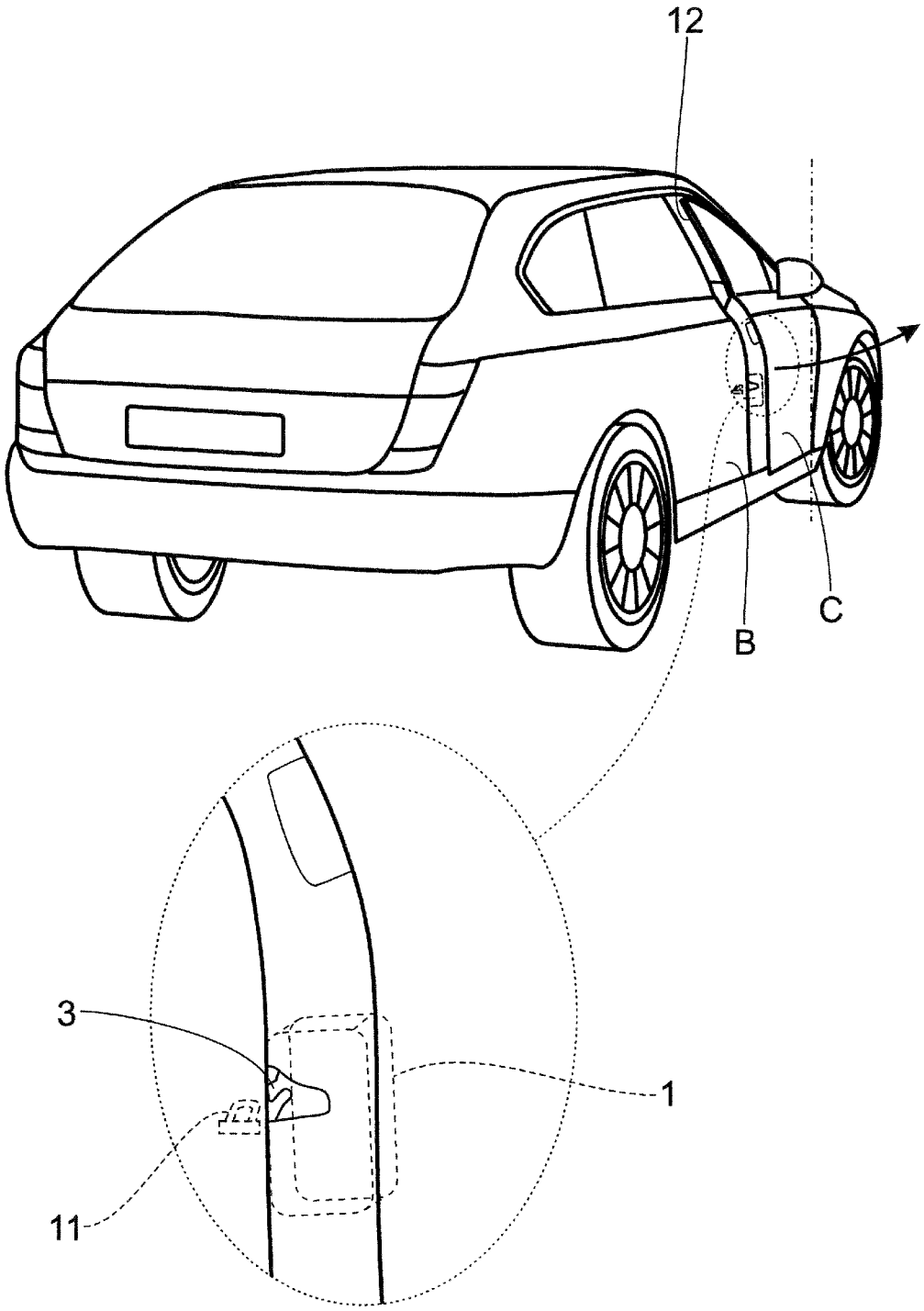

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

One example of a motor vehicle lock is provided in U.S. Pat. No. 6,471,259 B1. The motor vehicle lock may include a detent mechanism with a catch and a pawl, which interact with each other in order to hold the closing element in its respective closed position. For this, the catch may be pivoted between an open position, a primary closed position and a secondary closed position. For the opening function, a motorized opening drive is provided. For the cinching function, a motorized cinching drive is provided. Although in case of an emergency, the cinching drive is used for the cinching-function as well as for the opening-function, the opening drive is necessary in any case for moving cinching-drive out of the path of movement of the catch.

The proposed motor vehicle lock 1 may be assigned to any kind of closing element of a motor vehicle, insofar as reference is made to the introductory part of the specification.

The motor vehicle lock 1 may include a detent mechanism 2 with a catch 3 and a pawl 4, which interact with each other in the usual way, as will be explained.

The motor vehicle lock 1 may include a drivetrain arrangement 5 with a drive element 6. The drivetrain arrangement 5 is designed to transmit drive movements from the drive element 6 to detent mechanism 2. For this, motorized drive movements may be introduced into the drive elements 6, as will be explained as well.

The catch 3 may be pivoted around a catch axis 3*a* between an open position (FIG. 4*b*), a primary closed position (FIG. 3*a*) and a secondary closed position (FIG. 2*a*), which secondary closed position is situated between the open position and the primary closed position. The pawl 4 may be brought into an engaged state, blocking the catch 3 in the primary closed position (FIG. 3*a*) and in the secondary closed position (FIG. 2*a*) and may be raised into a release state (FIG. 3*b*) to release the catch 3. For this, the pawl 4 is pivotable around a pawl axis 4*a*.

A predefined drive direction 7 is assigned to the drive element 6. In the drawings, this predefined drive direction 7 is the clockwise direction. The drive element 6 may also be moved in a reverse direction 8, which is opposite to the drive direction 7. The drive element 6 is pivotable around a drive element axis 6*a*.

The sequence of FIG. 2*a*, 2*b* represents a cinching sequence, which is caused by driving the drive element 6 in the predefined drive direction 7. In the cinching sequence, the drivetrain arrangement 5 enters into engagement with the catch 3 and drives the catch 3 in its closing direction 9 into its primary closed position, preferably into an overtravel position beyond the primary closed position as shown in FIG. 2*b*. Here and preferably, for the cinching sequence, the initial position of the catch 3 is the secondary closed position (FIG. 2*a*), while the final position of the catch 3 is the primary closed position (FIG. 2*b*).

Figure 3:
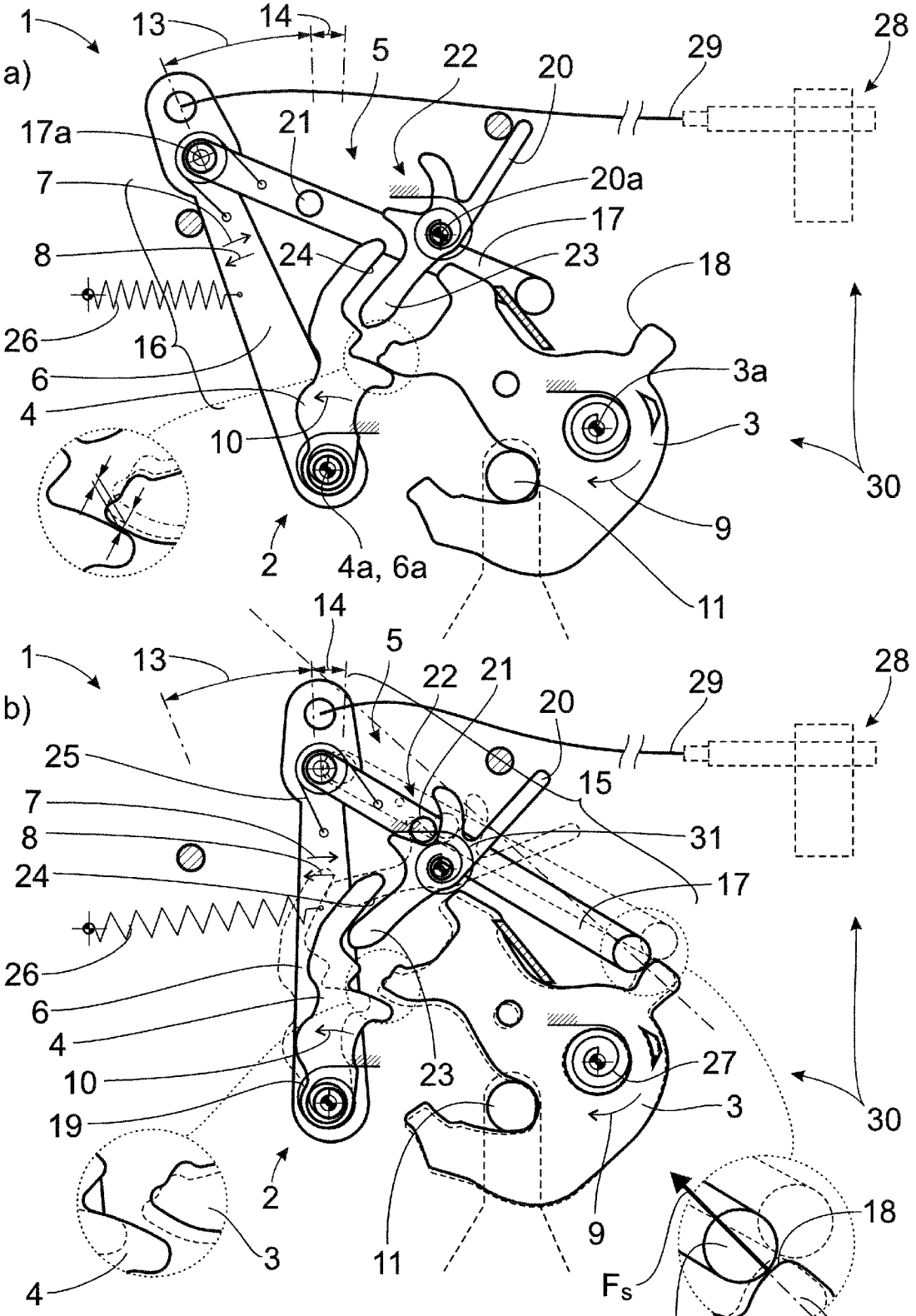
Figure 4:
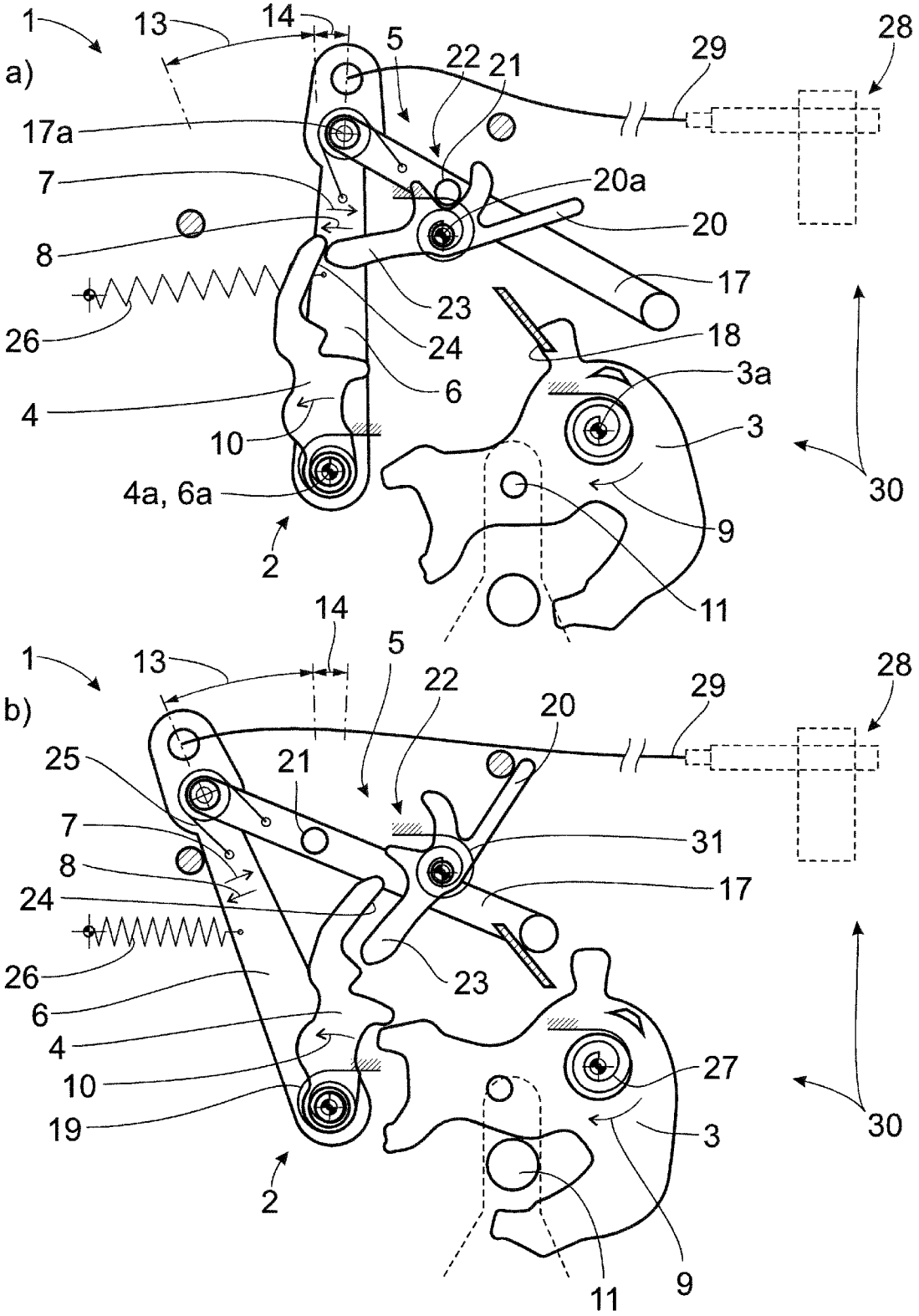

The sequence of FIG. 3*a*, 3*b*, 4*a*, 4*b* represents a release sequence, which is caused by driving the drive element 6 in the predefined drive direction 7 as well. During the release sequence, the drivetrain arrangement 5 enters into engagement with the pawl 4 and drives the pawl 4 in its release direction 10 into its release state (FIG. 4*a*).

During the release sequence, again by driving the drive element 6 in the predefined drive direction 7, the drivetrain arrangement 5 enters a clearance state (FIG. 4*a*), such that with the pawl 4 in its release state, the catch 3 may pivot into its open position free from the drivetrain arrangement 5. With the clearance state of the drivetrain arrangement 5 being caused by driving the drive element 6 in the predefined drive direction 7, the cinching sequence as well as the release sequence may be realized by introducing motorized movements into the drive element 6 in only one drive direction, which makes the resulting mechanical construction particularly simple.

Just as a matter of completeness, it may be pointed out, that the catch 3 in its closed position is in holding engagement with a lock striker 11. The motor vehicle lock 1 may be arranged at a closing element C, while the lock striker 11 is arranged at the body B of the motor vehicle. A vice versa arrangement is possible.

One interesting aspect of the shown embodiment is that during the release sequence, the pawl 4 enters its release state just before the drivetrain arrangement 5 enters its clearance state. This is indicated in dotted lines in FIG. 3*b*. The resulting effect is that after the pawl 4 enters its release state, the catch 3 is driven into its open direction by the high forces going back on the still compressed seal 12 of the closing element C. This driving of the catch 3 into its open direction urges the drivetrain arrangement 5 into its clearance state. Due to the high forces going back on the seal 12 of the closing element C, the transition of the drivetrain arrangement 5 into the clearance state is guaranteed in any case, even if parts of the motor vehicle lock 1 are temporarily blocked, for example by icing.

The drivetrain arrangement 5, when not in a clearance state, is in an engagement state, in which it is situated in the path of movement of the catch 3 in view of a movement of the catch 3 into its open position.

The shown embodiment allows for moving the pawl 4 into its release state with low driving force. This is because during the release sequence, by driving the drive element 6 in the predefined drive direction 7, the drivetrain arrangement 5 enters into engagement with the catch 3 and moves the catch 3 in its closing direction into an overtravel position beyond the primary closed position, while or before the pawl 4 enters its release state.

The cinching sequence goes back on a cinching drive movement 13 of the drive element 6, while the release sequence goes back on a release drive movement 14 of the drive element 6. This is indicated in the drawings. Here it becomes apparent, that the cinching drive movement 13 and the release drive movement 14 are adjoining each other with respect to the position of the drive element 6. However, the drive element 6, before starting the release sequence, is being reversed into its initial position as shown in FIG. 3*a*.

A comparison of FIG. 2*b* and FIG. 3*b* shows that the drivetrain arrangement 5 including a catch drivetrain 15 between the drive element 6 and the catch 3 (FIG. 2*b*) and a pawl drivetrain 16 between the drivetrain element 6 and the pawl 4, wherein the catch drivetrain 15 and the pawl drivetrain 16 are at least partly different from each other.

Various constructional embodiments for the realization of the proposed solution are possible. In the embodiment shown in the drawings, the catch drivetrain 15 may include a catch engagement lever 17, which, during the cinching sequence, is driven to enter into engagement with an engagement surface 18 of the catch 3, thereby driving the catch 3 into its primary closed position and, here and into the overtravel position beyond the primary closed position. The catch drivetrain 15 may include the drive element 6 as well as the catch engagement lever 17, which catch engagement lever 17 is pivotably coupled to the drive element 6 at a catch engagement lever axis 17*a*. When the drive element 6 is driven in its predefined drive direction 7 starting from the situation shown in FIG. 2*a*, the catch engagement lever 17 enters into engagement with the engagement surface 18 of the catch 3, thereby driving the catch 3, from the secondary closed position, into its primary closed position. In order to allow the pawl 4 to fall into its engagement state due to the force of the pawl spring 19, the catch engagement lever 17 drives the catch 3 into the overtravel position beyond the primary closed position. This is shown in FIG. 2*b*.

Interesting is the fact that during the release sequence, the drivetrain arrangement 5 enters its above noted clearance state by the catch engagement lever 17 being deflected into a deflected state, such that the catch engagement lever 17 is outside the path of movement of the catch 3 with respect to a movement of the catch 3 into its open position. The deflected catch engagement lever 17, may be outside the path of movement of the catch 3 as noted above, is shown in FIG. 3*b*. Here it becomes apparent, that the deflection of the catch engagement lever 17 is a deflection of the catch engagement lever 17 around its catch engagement lever axis 17*a*.

There are various ways for the realization of the deflection of the catch engagement lever 17. The deflection of the catch engagement lever 17 may be caused or least initiated, by interaction between the catch engagement lever 17 and the engagement surface 18 of the catch 3, when the catch 3 reaches a switching position, which is beyond the primary closed position and in one or more embodiments, beyond the overtravel position of the catch 3.

In the shown in one or more embodiments, the catch engagement lever 17 virtually slips off the engagement surface 18 of the catch 3, when the catch 3 reaches the switching position, which is shown in FIG. 3*b*. It is to be noted, that the deflection of the catch engagement lever 17 may not take place before the catch 3 reaches the switching position, as the cinching sequence would be interrupted before the pawl 4 can safely fall into its engagement state.

This means that during the cinching sequence, the engagement between the catch engagement lever 17 and the engagement surface 18 is such that the engagement itself does not cause a deflection of the catch engagement lever 17. However, during the release sequence, with the catch 3 in the switching position as shown in FIG. 3*a*, the catch 3 urges the catch engagement lever 17 into its deflected state.

Figure 2:
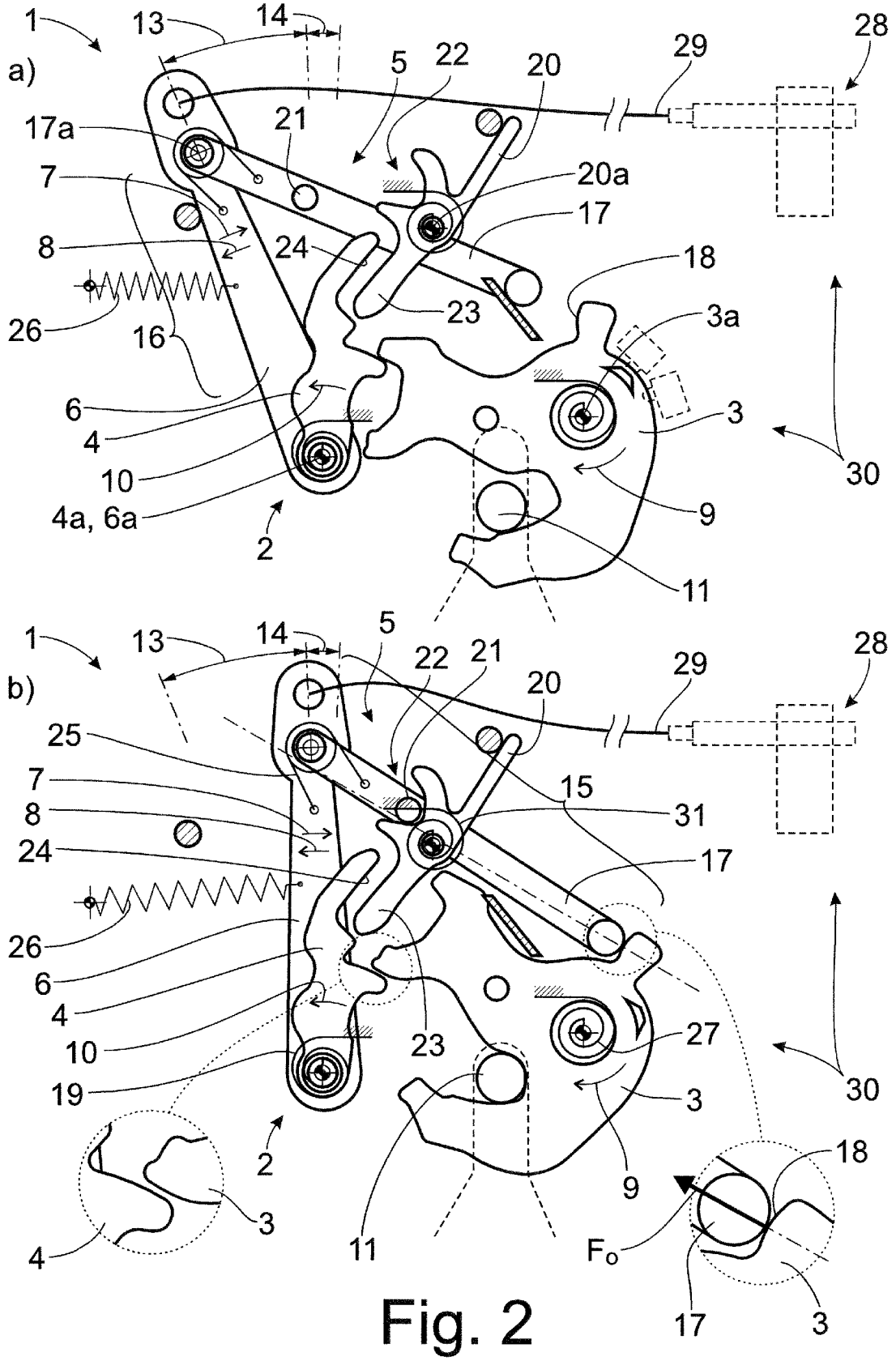

The above noted change in engagement between the catch engagement lever 17 and the engagement surface 18 during driving the catch 3 from the over-travel position (FIG. 2*b*) into the switching position (FIG. 3*b*) goes back on the alignment of the contact surface between the catch engagement lever 17 and the engagement surface 18 being changed, which results in a change in direction of the force acting from the catch 3 onto the catch engagement lever 17. In FIG. 2, the resulting force Fo is passing through the drive element axis 6*a*, not leading to any deflection of the catch engagement lever 17. In FIG. 3*b* the resulting force Fs passes by the drive element axis 6*a*, such that a momentum of force is evolving around the catch engagement lever axis 17*a*, urging the catch engagement lever 17 into its deflected state.

In addition or as an alternative, the deflection of the catch engagement lever 17 may be caused or continued, by the interaction between the catch engagement lever 17 and a deflection lever 20. For this engagement, the catch engagement lever 17 may include an engagement section 21, which, during the release sequence, comes into engagement with the deflection lever 20. For this engagement, the deflection lever 20 may include a forklike engagement section 22. A deflection lever spring 31 may be coupled to the deflection lever 20, to bias the deflection lever 20 into an initial position, in the drawings into a counter clockwise direction.

During the release sequence, the catch engagement lever 17 coming into engagement with the deflection lever 20 leads to the deflection lever 20 being pivoted around its deflection lever axis 20*a*, thereby further deflecting the catch engagement lever 17 out of engagement from the engagement surface 18 of the catch 3. This may be derived from the sequence of FIG. 3*a*, 3*b*.

With the drivetrain arrangement 5, the catch engagement lever 17, may move to a clearance state while or before the pawl 4 entering its release state, it is generally possible for the pawl 4 to be raised into its release state, when the catch 3 is beyond its primary closed position. This allows for the pawl 4 to be raised with a low driving force. The pawl 4 may be driven to a release state, when catch 3 is in its overtravel position as noted above.

FIG. 3*b* shows, that the pawl drivetrain 16 may include a pawl engagement lever 23, that, during the release sequence shown in FIG. 3*a*, 3*b*, 4*a*, 4*b*, is driven to come into engagement with an engagement surface 24 of the pawl 4, driving the pawl 4 into its release state as shown in FIG. 3*b*, 4*a*.

The deflection lever 20 and the pawl engagement lever 23 may be connected to each other. Further, the deflection lever 20 and the pawl engagement lever 23 may be a one-piece component.

The release sequence shown in FIG. 3*a*, 3*b*, 4*a*, 4*b* may work as follows: starting from the catch 3 being in its primary closed position, the drive element 6 is being driven in its predefined drive direction 7, in FIG. 3 in the clockwise direction. Here and preferably, the catch engagement lever 17 is coupled to drive element 6 via a coupling spring 25, which biases the catch engagement lever 17 into the position relative to the drive element 6 shown in FIG. 3*a*. Therefore, driving the drive element 6 in its predefined direction 7 leads to the catch engagement lever 17 entering into engagement with the engagement surface 18 of the catch 3, which catch 3 still is in its primary closed position. While this driving of the drive element 6, the catch 3 is driven into its overtravel position and subsequently into its switching position, in which the engagement surface 18 of the catch 3 urges the catch engagement lever 17 into its deflected state. Before or while the catch 3 reaches its switching state, the engagement section 21 of the catch engagement lever 17 comes into engagement with the forklike engagement section 22 of the deflection lever 20, which leads to the pawl engagement lever 23 raising the pawl 4 into its release state, as shown in FIG. 3*b*. Further movement of the drive element 6 in its predefined direction 7 leads to the deflection lever 20 being pivoted, which goes along with further deflecting the catch engagement lever 17. In the meantime, the catch 3 is driven into its open position by the catch spring 27 and, in particular, by the forces, that go back on the seal 12 of the closing element C. Finally, the drive element 6 is again released into its initial) position driven by drive element spring 26 (FIG. 4*b*).

In one or more embodiments, a motorized drive 28 may be provided, which may be coupled to the drive element 6 of the drivetrain arrangement 5 in order to provide a motorized cinching sequence and a motorized release sequence as noted above. Such motorized drive 28 is indicated in the drawings. The motorized drive 28 may be an integral part of the motor vehicle lock 1, leading to a compact overall arrangement. However, here and preferably, the motorized drive 28 is realized and arranged separately from the motor vehicle lock 1. Further preferably, the motorized drive 28 is coupled to the drive element 6 via a drive cable, in particular, a bowden cable 29.

According to second teaching, a motor vehicle lock arrangement 30 is claimed as such, which may include an above noted motor vehicle lock 1 as well as an above noted motorized drive 28. It is essential to this second teaching, that the motorized drive 28 is coupled to the drive element 6 of the drivetrain arrangement 5 in order to provide a motorized cinching sequence and a motorized release sequence. All explanations given for the motor vehicle lock 1 and its interaction with the motorized drive 28 are fully applicable to this teaching.

The motorized drive 28 may be arranged separately from the motor vehicle lock 1 as noted above. Further, the coupling between the motorized drive 28 and the drive element 6 may include a drive cable, and in particular, an above noted bowden cable 29, which is indicated in the drawings by just a solid line.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A motor vehicle lock including a detent mechanism, provided with a catch and a pawl, the motor vehicle lock comprising:

a drivetrain arrangement including a drive element;

wherein the catch is configured to be pivoted between an open position, a primary closed position, and a secondary closed position, wherein when the catch is in the secondary closed position, the catch is positioned between the open position and the primary closed position, wherein when the pawl is in an engaged state, the pawl blocks the catch when the catch is in the primary closed position, wherein when the catch is in the secondary closed position, the pawl is moveable to a release state to release the catch, wherein a drive element is configured to move in a predefined drive direction, wherein in a cinching sequence, the drive element moves in the predefined drive direction, such that the drivetrain arrangement engages the catch to drive the catch in a closing direction to the primary closed position, wherein in a release sequence, the drive element moves in the predefined drive direction, such that the drivetrain arrangement engages the pawl to drive the pawl in a release direction to the release state, and such that the drivetrain arrangement moves to a clearance state, and wherein when the drivetrain arrangement is in the clearance state, the pawl is in a release state such that the catch is pivotable to the open position free from the drivetrain arrangement, wherein in the release sequence, the drive element moves in the predefined drive direction such that the drivetrain arrangement engages and moves the catch in a closing direction to an overtravel position, beyond the primary closed position, while or before the pawl enters the release state.

2. The motor vehicle lock of claim 1, wherein in the release sequence, the pawl moves to the release state before the drivetrain arrangement moves to the clearance state, or wherein during the release sequence, the pawl enters the release state after the drivetrain arrangement enters the clearance state.

3. The motor vehicle lock of claim 1, wherein after the cinching sequence, the drive element moves in a reverse direction, opposite to the predefined drive direction.

4. The motor vehicle lock of claim 1, wherein the drivetrain arrangement includes a catch drivetrain, disposed between the drive element and the catch, and a pawl drivetrain, disposed between the drive element and the pawl, and wherein the catch drivetrain and the pawl drivetrain are at least partly different from each other.

5. The motor vehicle lock of claim 1, wherein the catch drivetrain includes a catch engagement lever, wherein during the cinching sequence, the catch engagement lever is driven to engage an engagement surface of the catch to drive the catch to the primary closed position.

6. The motor vehicle lock of claim 1, wherein the catch drivetrain includes a pawl engagement lever and wherein during the release sequence, the pawl engagement lever is driven to engage an engagement surface of the pawl to drive the pawl to a release state.

7. The motor vehicle lock of claim 6, wherein a deflection lever and the pawl engagement lever are unitarily formed with one another.

8. The motor vehicle lock of claim 1, further comprising a motorized drive, wherein the motorized drive is coupled to the drive element of the drivetrain arrangement to provide a motorized cinching sequence and a motorized release sequence.

9. The motor vehicle lock of claim 8, further comprising a cable, wherein the cable is operatively coupled to the motorized drive and the drive element.

10. A motor vehicle lock including a detent mechanism, provided with a catch and a pawl, the motor vehicle lock comprising:

a drivetrain arrangement including a drive element;

wherein the catch is configured to be pivoted between an open position, a primary closed position, and a secondary closed position, wherein when the catch is in the secondary closed position, the catch is positioned between the open position and the primary closed position, wherein when the pawl is in an engaged state, the pawl blocks the catch when the catch is in the primary closed position, wherein when the catch is in the secondary closed position, the pawl is moveable to a release state to release the catch, wherein the drive element is configured to move in a predefined drive direction, wherein in a cinching sequence, the drive element moves in the predefined drive direction, such that the drivetrain arrangement engages the catch to drive the catch in a closing direction to the primary closed position, wherein in a release sequence, the drive element moves in the predefined drive direction, such that the drivetrain arrangement engages the pawl to drive the pawl in a release direction to the release state, and such that the drivetrain arrangement moves to a clearance state, and wherein when the drivetrain arrangement is in the clearance state, the pawl is in a release state such that the catch is pivotable to the open position free from the drivetrain arrangement, wherein during the release sequence, the drivetrain arrangement enters the clearance state when a catch engagement lever deflects to a deflected state, such that the catch engagement lever is positioned outside the path of movement defined by the catch with respect to a movement of the catch to the open position, wherein in the release sequence, the drive element moves in the predefined drive direction such that the drivetrain arrangement engages and moves the catch in the closing direction to an overtravel position, beyond the primary closed position, while or before the pawl enters the release state.

11. The motor vehicle lock of claim 10, wherein when the catch reaches a switching position, the catch engagement lever interacts with an engagement surface of the catch to deflect the catch engagement lever to a deflected state, wherein the deflected state is beyond the primary closed position and/or an overtravel position of the catch.

12. The motor vehicle lock of claim 11, wherein during the release sequence and when the catch is disposed in the switching position, the catch biases the catch engagement lever to the deflected state.

13. The motor vehicle lock of claim 10, wherein the deflection of the catch engagement lever is at least partially caused by an interaction between the catch engagement lever and a deflection lever.

14. The motor vehicle lock of claim 13, wherein during the release sequence, the catch engagement lever engages the deflection lever to deflect the catch engagement lever such that the deflection lever disengages from an engagement surface of the catch engagement lever.

15. The motor vehicle lock of claim 10, wherein in the release sequence, the pawl moves to the release state before the drivetrain arrangement moves to the clearance state, or wherein during the release sequence, the pawl enters the release state after the drivetrain arrangement enters the clearance state.

16. The motor vehicle lock of claim 10, wherein after the cinching sequence, the drive element moves in a reverse direction, opposite to the predefined drive direction.

17. The motor vehicle lock of claim 10, further comprising a motorized drive, wherein the motorized drive is coupled to the drive element of the drivetrain arrangement to provide a motorized cinching sequence and a motorized release sequence.

18. A motor vehicle lock configured to perform a cinching sequence and a release sequence, the motor vehicle lock comprising:

a catch configured to pivot, in a closing direction and a release direction, between an open position, a primary closed position, and a secondary closed position, wherein when the catch is in the secondary closed position, the catch is positioned between the open position and the primary closed position;

a pawl configured to move to change between an engaged state and a released state, wherein when the catch is in the secondary closed position, the pawl is configured to change from the engaged state to the released state to release the catch;

a drive element configured to move in a predefined drive direction;

wherein during the cinching sequence, the drive element moves in the predefined drive direction to drive the catch in the closing direction to the primary closed position, wherein during the release sequence, the drive element moves in the predefined drive direction to a clearance state, to drive the pawl from the engaged state to the released state, and wherein when the drive element is in the clearance state, the catch is pivotable to the open position; and a catch engagement lever coupled to the drive element, wherein during the cinching sequence, the catch engagement lever moves to engage the catch to move the catch to an over travel position.

19. The motor vehicle lock of claim 18, further comprising a deflection lever, wherein during the release sequence, as the catch engagement lever moves the catch to the over travel position the catch engagement lever engages and moves the deflection lever such that the deflection lever engages and moves the pawl to the released state.

20. The motor vehicle lock of claim 18, further comprising a spring coupled to the drive element and wherein during the release sequence the spring is configured to move in a second predefined direction, opposite the predefined direction.

* * * * *